US005416711A

United States Patent [19]

Gran et al.

[11] Patent Number: 5,416,711

[45] Date of Patent: May 16, 1995

[54] INFRA-RED SENSOR SYSTEM FOR INTELLIGENT VEHICLE HIGHWAY SYSTEMS

[75] Inventors: Richard Gran, Farmingdale; Lim Cheung, Setauket, both of N.Y.

[73] Assignee: Grumman Aerospace Corporation, Bethpage, N.Y.

[21] Appl. No.: 138,736

[22] Filed: Oct. 18, 1993

[51] Int. Cl.[6] ..... G08G 1/01

[52] U.S. Cl. ..... 364/436; 364/437; 364/438; 340/933; 340/905

[58] Field of Search ..... 364/436, 437, 438, 439, 364/496, 497, 498, 499, 550, 551.01; 340/933, 934, 935, 936, 937, 541, 905

[56] References Cited

U.S. PATENT DOCUMENTS

| | | | |
|---|---|---|---|
| 4,847,772 | 7/1989 | Michalopoulos et al. | 364/436 |
| 5,083,204 | 1/1992 | Heard et al. | 358/113 |
| 5,136,397 | 8/1992 | Miyashita | 358/236 |
| 5,161,107 | 11/1992 | Mayeaux et al. | 364/436 |
| 5,182,555 | 1/1993 | Sumner | 340/905 |
| 5,210,702 | 5/1993 | Bishop et al. | 364/496 |
| 5,289,183 | 2/1994 | Hassett et al. | 340/905 |
| 5,296,852 | 3/1994 | Rathi | 340/933 |
| 5,317,311 | 5/1994 | Martell et al. | 340/905 |

*Primary Examiner*—Kevin J. Teska
*Assistant Examiner*—Susan Wieland
*Attorney, Agent, or Firm*—Scully, Scott, Murphy & Presser

[57] ABSTRACT

An infra-red sensor system for all weather, day and night traffic surveillance of ground based vehicles. The infra-red sensor system comprises system comprises an infra-red, focal plane array detector, signal processors, a communications interface and a central computer. The infra-red, focal plane array detector senses the heat emitted from vehicles passing within the field of view. Information collected from the array detector is input to signal processors which are programmed with tracking algorithms and other application specific algorithms to extract and calculate meaningful traffic data from the infra-red image captured by the array detector. The meaningful data includes the location, speed and acceleration of all vehicles passing within the field of view of the array detector. The information from the signal processors is transmitted to the central computer via the communications interface for further processing and dissemination of information.

44 Claims, 8 Drawing Sheets

MONITOR
218
SENSOR SIGNAL PROCESSOR
220
i-860 ARRAY PROCESSOR NODE
208
i-860 ARRAY PROCESSOR NODE
220
206
100
OVERHEAD SENSOR BOX
CCD VIDEO SENSOR
IR SENSOR HEAD
104
102
RS-170 VIDEO DIGITIZER
212
VIDEO OVERLAY GENERATOR
216
DIGITAL DATA LINE RECEIVERS
210
WINDOW PROCESSOR
214
204
VME 64 BIT DATA PATH (MULTIPLE SUB-FRAMES)
400
CENTRAL COMPUTER
300
LOCAL CONTROLLER
200
302
RS-232 I/O PORT
202
LOCAL HOST CONTROLLER

INFRA-RED SENSOR SYSTEM FOR INTELLIGENT VEHICLE HIGHWAY SYSTEMS

BACKGROUND OF THE INVENTION

1. Field of the Invention

The present invention relates to a sensor system for tracking ground based vehicles, and more particularly, to a passive infra-red sensor system which is used in conjunction with Intelligent Vehicle Highway Systems to determine traffic information including the location, number, weight, axle loading, speed and acceleration of the vehicles that are in the field of view. In addition, the infra-red sensor system can be utilized to obtain information on adverse weather situations, to determine the emissions content of the vehicles, and to determine if a vehicle is being driven in a reckless manner by measuring its lateral acceleration.

2. Discussion of the Prior Art

The loss in productivity and time from traffic congestion as well as the problems caused by excess pollution are a significant drain on the economy of the United States. The solution, the management of ground based vehicular traffic, is becoming an increasingly complex problem in todays mobile society, but one that must be addressed. The goal of traffic management is to provide for the efficient and safe utilization of the nation's roads and highway systems. To achieve this simple goal of efficiency and safety, a variety of traditional sensor systems have been utilized to monitor and ultimately control traffic flow. Any traffic monitoring system requires a sensor or sensors of some kind. There are two general categories of sensors, intrusive and non-intrusive. Intrusive sensors require modification of, and interference with, existing systems. An example of a system incorporating intrusive sensors is a loop detector, which requires installation in the pavement. Non-intrusive sensors are generally based on more advanced technology, like radar based systems, and do not require road work and pavement modification. Within each of the two general categories, there are two further types of sensors, active and passive. Active sensors emit signals that are detected and analyzed. Radar systems are an example of systems utilizing active sensors. Radar based systems emit microwave frequency signals and measure the Doppler shift between the signal reflected off the object of interest and the transmitted signal. Given the current concern with electro-magnetic interference/electro-magnetic fields, EMI/EMF, and its effect on the human body, there is a general sense that the use of active sensors will be limited. Passive sensors are generally based upon some type of image detection, either video or infra-red, pressure related detection such as fiber optics, or magnetic detection such as loop detectors.

The loop detector has been used for more than forty years, and is currently the sensor most widely used for traffic detection and monitoring. The loop detector is a simple device wherein a wire loop is built into the pavement at predetermined locations. The magnetic field generated by a vehicle as it passes over the loop induces a current in the wire loop. The current induced in the wire loop is then processed and information regarding traffic flow and density is calculated from this data. Although loop detectors are the most widely used systems for traffic detection, it is more because they have been the only reliable technology available for the job, until recently, rather than the technology of choice. In addition, a significant drawback of the loop detectors is that when a loop detector fails or requires maintenance, lane closure is required to effect repairs. Given that the goal of these systems is to promote efficiency, and eliminate lane closure for maintenance and repair, loop detectors present a less than ideal solution.

A second common type of traffic sensor is closed circuit television. Closed circuit television (CCTV) has been in wide use for verification of incidents at specific locations, including intersections and highway on-ramps. Although CCTV provides the system operator with a good quality visual image in the absence of precipitation or fog, they are not able to provide the data required to efficiently manage traffic. The CCTV based system also represents additional drawbacks in that it requires labor intensive operation. One system operator can not efficiently monitor hundreds of video screens, no matter how well trained.

An advanced application which stems from the CCTV based system is video imaging. Video imaging uses the CCTV as a sensor, and from the CCTV output is able to derive data from the video image by breaking the image into pixel areas. Using this technology, it is possible to determine lane occupancy, vehicle speed, vehicle type, and thereby calculate traffic density. One video camera can now cover one four-way intersection, or six lanes of traffic. However, a drawback to video imaging is that it is impacted by inclement weather. For example, rain, snow or the like cause interference with the image. There are currently several companies that are marketing video imaging systems. Some of these systems are based upon the WINDOWS TM graphical user interface, while other companies have developed proprietary graphic user interfaces. All of these systems are fairly new, so there is not a wealth of long term data to support their overall accuracy and reliability.

As an alternative to video imaging, active infra-red detectors are utilized. Active infra-red detectors emit a signal that is detected on the opposite side of the road or highway. This signal is very directional, and is emitted at an angle to allow for height detection. The length of time a vehicle is in the detection area also allows for the active infra-red detector system to calculate vehicle length. Using this data, an active infra-red detector system is able to determine lane occupancy and vehicle type and calculate vehicle speed and traffic density. Additionally, over the distances that a typical highway sensor will observe, typically a maximum of approximately three hundred yards, active infra-red detectors are not hampered by the inclement weather over which video imaging systems fail to operate. However, in a multiple lane environment, due to detector placement on the opposite side of the road from the emitter, there can be a masking of vehicles if the two vehicles are in the detection area at the same time.

SUMMARY OF THE INVENTION

The present invention is directed to an infra-red sensor system for tracking ground based vehicles to determine traffic information for a particular area or areas. The infra-red sensor system comprises a sensor unit having at least one array detector for continuously capturing images of a particular traffic corridor, a signal processor unit which is connected to the sensor unit for extracting data contained within the images captured by the array detector and calculating traffic information therefrom, and a local controller unit connected to the signal processor unit for providing and controlling a communication link between the infra-red sensor system and a central control system. The sensor unit is mounted on an overhead support structure so that the array detector has an unobstructed view of the traffic corridor. The signal processor unit calculates certain traffic information including the location, number, weight, axle loading, velocity, acceleration, lateral acceleration, and emissions content of all ground based vehicles passing within the field of view of the array detector. The local controller comprises a central computer which is operable to process information from a multiplicity of infra-red sensor systems. The infra-red sensor system of the present invention provides for all weather, day and night traffic surveillance by utilizing an infra-red, focal plane array detector to sense heat emitted from vehicles passing through the detector's field of view. Signal processors with tracking algorithms extract meaningful traffic data from the infra-red image captured and supplied by the focal plane array detector. The meaningful traffic data is then transmitted via a communications link to a central computer for further processing including coordination with other infra-red sensor systems and information dissemination.

The infra-red sensor system of the present invention utilizes demonstrated and deployed aerospace technology to deliver a multitude of functions for the intelligent management of highway and local traffic. The infra-red sensor system can be utilized to determine traffic flow patterns, occupancy, local area pollution levels, and can be utilized to detect and report traffic incidents. The focal plane array detector, which is the core of the infra-red sensor system, is capable of measuring certain basic information including the vehicle count, vehicle density and the speed of all the individual vehicles within the focal plane array detector's field of view. With the addition of special purpose electro-optics and signal processing modules, more detailed information can be determined from the basic information captured by the focal plane array detector, including vehicular emission pollution level and weight-in-motion data.

The infra-red focal plane array detector is essentially cubic in shape having sides of approximately twenty centimeters, and is contained in a sealed weather-proof box that can be mounted on an overhead post or other building fixture. Depending on the layout of the intersection or installation point, more than one traffic corridor can be monitored by a single focal plane array detector. The focal plane array detector responds in an infra-red wavelength region that is specifically selected for the combination of high target emission and high atmospheric transparency. The focal plane array detector is connected to the signal processing module by a power and data cable. The signal processing module is housed in a ruggedized chassis that can be located inside a standard traffic box on the curb side. The signal processing module and its associated software provide for the extraction of useful information needed for traffic control from the raw data provided by the focal plane array detector while rejecting background clutter. During normal operation only the traffic flow and density are computed. However, during the enhanced mode of operation, more detailed information is calculated. This more detailed information includes the number of vehicles within the focal plane array detector's field of view, the velocity and acceleration of each individual vehicle, including lateral acceleration, the average number of vehicles entering the region per minute, and the number of traffic violators and their positions. In addition, the focal plane array detector can be equipped with a spectral filter and the signal processors of the signal processing module programmed with specialized software such that the infra-red sensor system has the capability to investigate general area pollution and individual vehicle emission. The signal processing module effectively distills the huge volume of raw data collected by the focal plane array detector into several tens of bytes per second of useful information. Accordingly, only a low bandwidth and inexpensive communication network and a central computer with modest throughput capacity is needed for managing the multiplicity of distributed infra-red sensor systems in the field.

An option available with the infra-red sensor system is the capability to generate a digitally compressed still image or a time-lapse sequence image for transmission to the control center for further evaluation. This capability is particularly beneficial in traffic tie-ups or accidents. This capability can also be extended to determine a traffic violators current position and predicted path so that law enforcement officials can be deployed to an intercept location. Alternatively, an auxiliary video camera can be autonomously triggered by its associated local signal processing module to make an image record of the traffic violator and his/her license plate for automated ticketing.

The infra-red sensor system of the present invention generates and provides information that when used in actual traffic control operation can be used to adjust traffic light timing patterns, control freeway entrance and exit ramps, activate motorist information displays, and relay information to radio stations and local law enforcement officials. The infra-red sensor system is easily deployed and utilized because of its flexible modes of installation, because each individual focal plane array detector provides coverage of multiple lanes and intersections, and because it uses existing communication links to a central computer. The infra-red sensor system is a reliable, all weather system which works with intelligent vehicle highway systems to determine and disseminate information including the location, number, weight, axle loading, speed and acceleration of vehicles in its field of view. Additionally, with only slight modification the infra-red sensor system can be utilized to obtain information on adverse weather conditions, to determine the emissions content of individual vehicles, and to determine if a vehicle is being driven in a reckless manner by measuring its lateral acceleration.

The deployment of multiple infra-red sensor systems which are interconnected to a central control processor will provide an affordable, passive, non-intrusive method for monitoring and controlling major traffic corridors and interchanges. The infra-red sensor system of the present invention utilizes a combination of proven technologies to provide for the effective instrumentation of existing roadways to gain better knowledge of local traffic and environmental conditions.

DETAILED DESCRIPTION OF THE PREFERRED EMBODIMENTS

The infra-red sensor system of the present invention provides for all weather, day and night traffic surveillance by utilizing an infra-red focal plane array detector to sense and track heat emitted from vehicles passing through the focal plane array detector's field of view. The infra-red focal plane array detector can provide multi-dimensional data in the spatial domain, in the temporal domain, and in the spectral domain. Multiple signal processors are utilized in conjunction with the infra-red focal plane array detector to process the multi-dimensional data. The signal processors utilize tracking algorithms and other application specific algorithms to extract and calculate meaningful traffic data from the infra-red images captured and supplied by the infra-red focal plane array detector. The meaningful traffic data is then transmitted via a communications link to a central computer for further processing including coordination with other infra-red sensor systems and information dissemination. The information, when used in an actual traffic control operation, can be utilized to adjust traffic light timing patterns, control freeway exit and entrance ramps, activate motorist information displays, and relay information to radio stations and local law enforcement officials.

Infra-Red Sensor System Architecture

Figure 1:
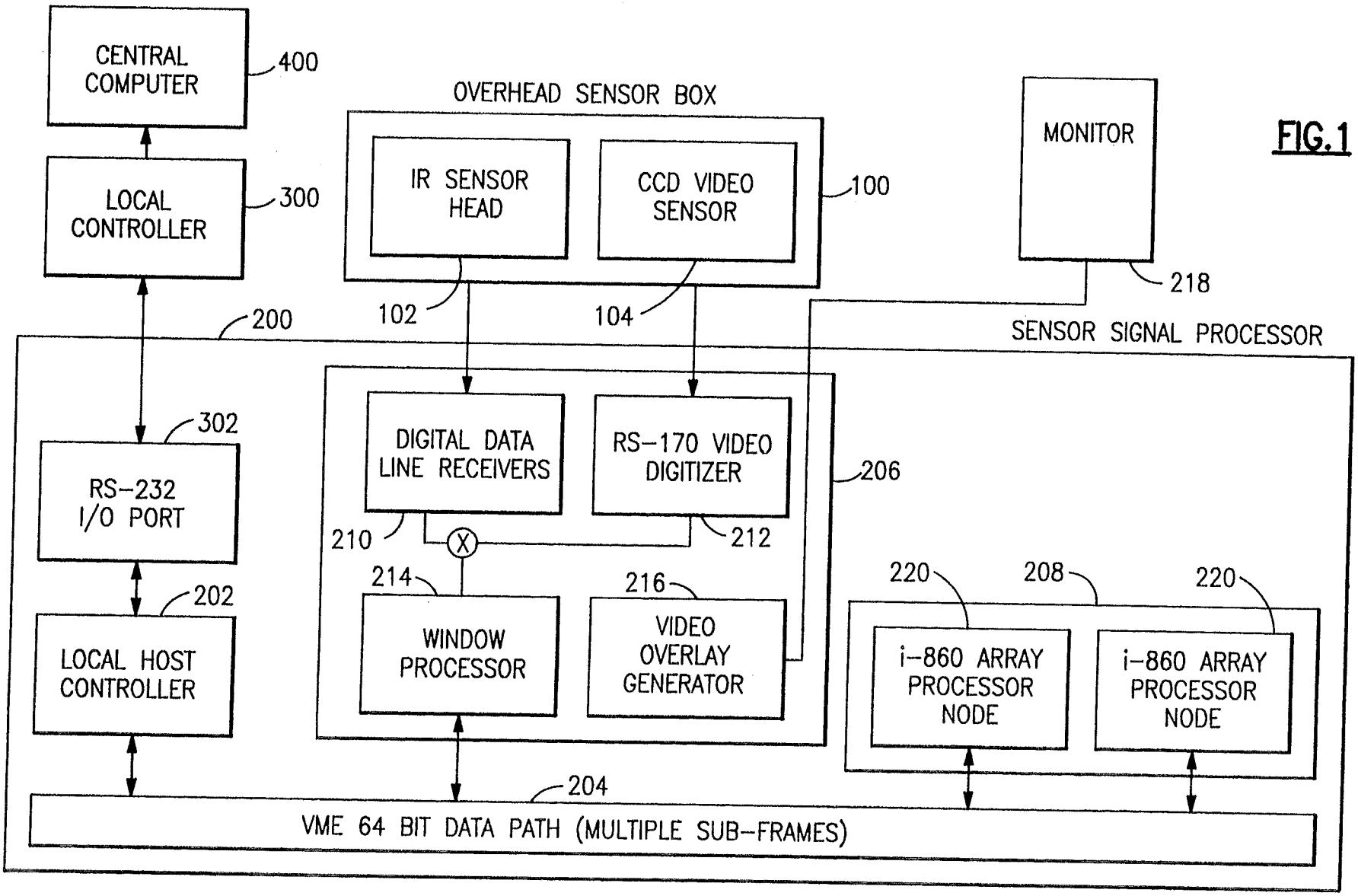
FIG. 1 is a block diagram representation of the hardware architecture of the infra-red sensor system of the present invention.

The infra-red sensor system comprises three elements, the sensor unit, the signal processor unit, and a local controller unit. The local controller comprises a communications link for communication with a central computer. Referring to FIG. 1, there is shown a block diagram of the infra-red sensor system hardware architecture. The sensor unit 100 comprises one or more individual sensor heads 102 and 104. The sensor heads 102 and 104 are contained in a sealed weather proof box that can be mounted on an overhead post or other building fixture. One sensor head 102 is an infra-red focal plane array imaging device, and a second sensor head 104, which is optional, is equipped with a visual band, charged-coupled device imager. The infra-red focal plane array imaging device 102 produces a two dimensional, typically 256×256 pixels or larger, RS-170 compatible image in the three to five micron band. The output of the infra-red focal plane array imaging device 102 is digitized by on-board sensor head electronics, discussed in detail in subsequent sections. The charge-coupled device imager 104 produces a standard five hundred twenty-five line RS-170 compatible video image. The output of the charge-coupled device imager 104 is also digitized by on-board sensor head electronics. Note, however, that the signal processor unit 200 has the capability to digitize multiple channel sensor signals if necessary, depending on the installation requirements. The infra-red focal plane array imaging device 102 is the core of the sensor unit 100, whereas the charge-coupled device imager 104 is optional and can be replaced by other imaging units including seismic sensors, acoustic sensors and microwave radar units, for increased functionality. Interchangeable lenses may be used to provide the appropriate field of view coverage, depending on the installation location. In addition, it is possible to use a simple beam splitter to multiplex several fields of view so that only one imaging device is needed at each infra-red sensor system location. The output of each imaging device 102 and 104 is hardwired to the signal processor unit 200.

The signal processor unit 200 comprises a local host computer 202, a ruggedized chassis, including a sixty-four bit data oath bus 204 such as the VME-64 bus, multiple window processor boards 206, and multiple distributed signal processor boards 208. The basic hardware architecture is open in the sense that the system input/output and computing power are expandable by plugging in additional boards, and that a variety of hardware can be flexibly accommodated with minor software changes.

The window processor boards 206 are custom electronics boards that accept either the parallel differential digital video and timing signals produced by the on-board sensor head electronics, or a standard RS-170 analog video from any other imaging source for subsequent processing. Therefore, as stated above, the output signals from the imaging devices 102 and 104 can be either digital or analog. If the signals are digitized by the sensor head electronics, the differential digital signals are first received by line receivers 210 and converted into single ended TTL compatible signals. If the signals are analog, they are routed to an RS-170 video digitizer 212 which comprises a set of gain and offset amplifiers for conditioning the signals, and an eight-bit analog-to-digital converter for conversion of the analog signals into digital signals. Regardless of the original signal type, the digital output data is ultimately routed to the VME-64 data bus 204 to be shared by other video boards. The signals, however, are first routed through a window processor 214 which only passes pixel data which falls into a particular window within an image. The size and locations of the windows are programmable in real time by the local host computer 202. Windows up to the full image size are permitted. The windowed pixel data is then loaded into a first-in-first-out register for buffering. The output from the register is directed to the VME data bus 204 through a bus interface of said window processor 214. The register can hold one complete image of 640×486 pixels of sixteen bits. The output of the window processor 214 is passed through the VME data bus 204 to the multiple distributed signal processor boards 208. It is important to note that the window processor board 206 and the multiple distributed signal processor board 208 are configurable for use in a multiple distributed signal processor/window processor environment.

Essentially, the function of the window processor 214 is to partition the input sensor data into multiple sub-regions so that each sub-region may be directed to one of several array signal processors which comprise the multiple distributed signal processor board 208. As a consequence of this, the multiple distributed signal processors of the multiple distributed signal processor board 208 can operate in parallel for real time signal processing. Each sub-region is processed independently by one of the signal processors. The sub-regions are processed in both the spatial domain and temporal domain to identify vehicles and reject people, buildings or other background clutter. The spatial domain processing is achieved by dividing the image into smaller portions on a pixel by pixel basis, and the temporal domain processing is achieved by a frame distribution. The results are a set of tracks that start from one side of the image and end at the opposite side. New vehicle tracks are formed and terminated continuously. The signal processing hardware and software are capable of handling hundreds of tracks simultaneously.

A cursor overlay generator 216 is utilized to overlay a white or black programmable cursor, or box cursor on the input RS-170 video and provide overlay RS-170 video which is output to a monitor 218. The function of the cursor overlay generator 216 is to provide a manual designation crosshair and track a crosshair. The images can then be viewed real time on the video monitor 218.

The wideband industry standard VME data bus 204 provides the link between the various boards 202, 206 and 208 which comprises the signal processing unit 200. The high bandwidth of the VME data bus 204 allows multiple sensor units 100 to be connected simultaneously to the same signal processing unit 200. In this way, one signal processor unit chassis can handle multiple sensor heads spaced up to one kilometer apart. The VME data bus 204 is part of the VME-64 chassis which also holds the window processing boards 206 and the signal processing boards 208. The chassis also provides the electrical power for all of the boards 202, 206 and 208, the cooling, and the mechanical structure to hold all the boards 202, 206, and 208 in place. The VME data bus 204 supports data rates up to seventy megabytes per second. Accordingly, a full 640×486 pixel image can be passed in less than ten milliseconds.

The multiple distributed signal processor boards 208 are the compute engine of the infra-red sensor system. Each board 208 contains an Intel i860 high speed pipeline processor 220 and eight megabytes of associated memory. Each processor 220 of the multiple distributed signal processor board 208 takes a partitioned sub-region of the image from the infra-red focal plane imaging unit 102 or other imaging device 104 and processes the data in parallel with the other boards 208. The sub-regions may either be processed by the same set of instructions, or by completely different instructions. Thus one sub-region of the infra-red focal plane array imaging device 102 may be processed for temporal frequency information, another sub-region may be processed for spectral frequency information, and a third sub-region may be processed for intensity information for multi-target tracking. The programs for each of the multiple distributed signal processors 220 are developed in the local host computer 202 and downloaded to the boards 208 at execution time. The output of the multiple distributed processors boards 208 are transmitted via the VME-64 data bus 204 back to the local host computer 202 where they are re-assembled and output to the central computer 400.

The local host computer 202 provides the user interface and the software development environment for coding and debugging the programs for the window processor boards 206 and the multiple distributed signal processor boards 208. It also provides the graphic display for the control of the images and for viewing the images produced by the infra-red imagers 102 and 104. A bus adapter card links the local host computer 202 with the VME-64 chassis. The local host computer 202 is an industry standard UNIX compatible single board computer. Another function the local host computer 202 performs is the generation of the necessary clocking signals which allow for the agile partitioning of the infra-red focal plane array images into sub-regions at variable integration times and frame rates. The location and size of the sub-region may be designated manually by a mouse, or determined by the output of the multiple distributed signal processors 220. The generated timing signal pattern may be downloaded to the electronics of the sensor head 100.

The local host computer 202 can also be utilized to control area traffic lights. The information from the infra-red sensor system, specifically, the traffic density in a particular traffic corridor can be utilized to set and control the area's traffic lights. For example, by determining the length of the traffic queue, the number of vehicles that will enter or exit the traffic queue, and the number of turning vehicles in the traffic queue, the local host computer 202 can determine the appropriate light changing pattern and update it at different times to correspond to usage. In addition, this information can be transmitted to the central computer 400 for dissemination and coordination with other infra-red sensor systems.

The local controller 300 unit is equipped with a microprocesser based local controller that comprises a RS-232 serial line and modem compatible with the data protocal used in existing local data and central controllers. Additionally, a leased telephone line or a radio transponder equipped with a data modem is employed as a back-up, two-way communication link between the local infra-red sensor system and the central control room for out of the ordinary development testing purposes such as system performance diagnostic or program update. Because the present design provides for all video processing to take place on board the sensor heads 100 and signal processor unit 200, the output data rate is low enough to be handled by an inexpensive RS-232 type data link. Processed data is transmitted at low baud rate from the infra-red sensor system to the central control room. Continuing signal processing software upgrade and real-time scene inspection may be possible from remote cities via a telephone modem line. With data compression, a still snapshot can be sent to the traffic control center occasionally over the existing low bandwidth link. Other alternative telemetry arrangements may be investigated and substituted to exploit the enhanced capability of the new sensor. The local controller 300 is connected via an RS-232 input/output port 302 to the local host computer 202 of the signal processing unit 200.

Infra-Red Sensors

The infra-red sensors are staring mosaic sensors, which are essentially digital infra-red television. In these sensors, the particular scene being viewed is divided into picture elements or pixels. There are 486×640 pixel elements in the infra-red sensors of the present invention but focal planes of other sizes can easily be inserted into the basic system. Each of these pixels can be made to respond to a broad range of colors, infra-red frequencies, or can be specialized to look at only very narrow infra-red frequencies. Each of the individual pixels in the sensors are equivalent to an independent infra-red detector. Accordingly, each may be processed on an individual pixel basis to extract the temporal data, or, with adjacent pixels in a single frame to extract the spatial data. The ability to do only the temporal, spatial or spectral processing separately or to combine them is a unique feature of the infra-red sensor system because it allows essentially unlimited options for the extraction of data. The infra-red bands utilized are wider than the water vapor absorption areas of the spectrum, thereby allowing the infra-red sensor system to operate in all weather conditions. In addition, the infra-red sensor system can be utilized to detect and report adverse weather conditions.

The infra-red sensors utilized are operable to work in one of three functional modes. In a first functional mode, a full frame, two-dimensional X-Y imaging camera having a variable frame rate and variable integration time is designed to adaptively adjust to specific mission requirements and to provide extended dynamic range and temporal bandwidth. In a second functional mode, a non-imaging multiple target tracking camera is designed to detect and track the position and velocity of all vehicles in the tracking cameras field of view. In a third functional mode, an agile spatial, temporal and spectral camera is used which can be programmed to selectively read out sub-regions of the focal plane array at variable rates and integration times.

The above described functional modes are utilized at various times during the typical life cycle of operations of the infra-red sensor system. For example, the first functional mode of operation can be used to obtain a video image showing the condition of the particular road or highway at selected time intervals. This mode of operation allows the system operator to visually inspect any anomalies, causes of accidents, and causes of traffic jams. During intervals of time when an operator is not needed or unavailable, the infra-red sensor is switched to the second functional mode. In this mode, the infra-red sensor unit 100 and the signal processing unit 200 are used to automatically monitor the traffic statistics over an extended stretch of the highway that may contain multiple lanes, signalized intersections, entry and exit ramps, and turn lanes. Accordingly, any vehicles that exceed the speed limit, or produce a high level of exhaust emissions thereby signifying potential polluters, will be flagged by the central computer 400. These potential violators will then be interrogated by the infra-red sensor system in more detail. The more detailed interrogation is accomplished in the third functional mode of operation. In the third functional mode, the flagged targets are tracked electronically in the spatial, temporal, and spectral sub-regions in order to determine more detailed information. The target exhaust can be scanned spectroscopically in particular wave lengths so that a quantative spectrum can be developed showing the concentration of various gaseous emissions. Additionally the pulsation of the exhaust plumes which gives an indication of the engine RPM can be counted in the high temporal resolution mode and the sub-region read out rate may also be increased to yield better resolution on the vehicle velocity.

Figure 2:
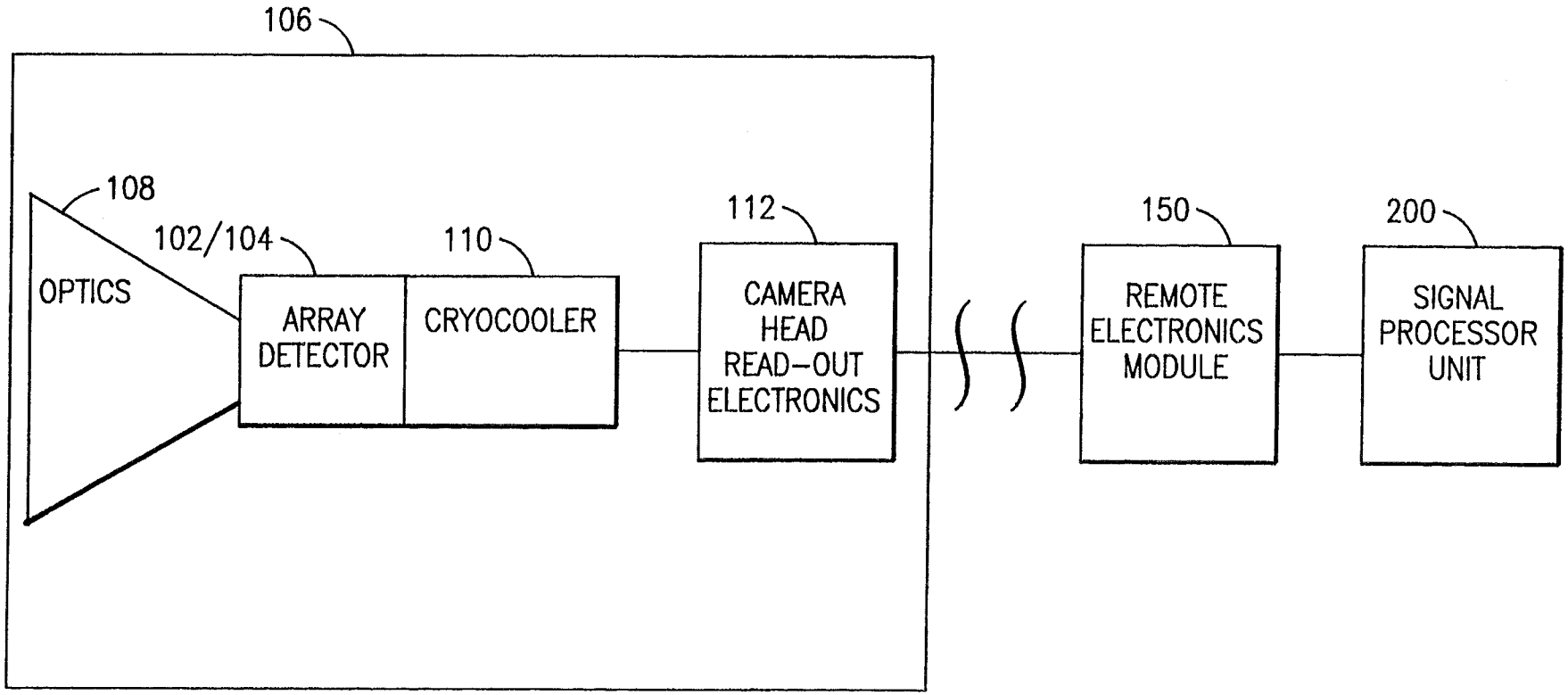
FIG. 2 is a block diagram representation of the infra-red sensors and their associated electronics which comprise the infra-red sensor system of the present invention.

Referring to FIG. 2, there is shown a block diagram of the infra-red sensors and their associated electronics. There are essentially two components which comprise the infra-red sensors and their associated electronics, the camera head electro-optics module 106 and the remote electronics module 150. The camera head electro-optics module 106 comprises the camera optics 108, the array detector 102 or 104, which may be either an infra-red focal plane array or a visual band charge-coupled device imager, a cryocooler unit 110, and the camera head read-out electronics 112. The camera head read-out electronics 112 are located immediately adjacent to the array detector 102/104 to minimize the effects of noise. The camera head read-out electronics 112 provides for the necessary clock signals, power, and biases to operate the infra-red focal plane array 102 or the visual band charge-coupled device imager 104. The camera head read-out electronics 112 also provide for the digitizing of the output of the array detector 102/104, regardless of which type, into twelve bit digital words and transmits the data along twelve differential pairs together with the camera synchronizing signals to the remote electronics module 150. The remote electronics module 150 is generally located some distance away from the camera head electro-optics module 112, such as in a traffic control box located on the curbside. For short separation distances, up to fifty meters, regular twisted pair copper cables are used to connect the camera head read-out electronics module 112 and the remote electronics module 150. Fiber optics cables are used for longer separation distances. The remote electronics module 150 accepts the digitized data from the camera head read-out electronics 112 as input, performs gain and non-conformity corrections, performs scan conversion to yield an RS-170 composite video, and provides various control functions for the system operator or the central computer 400. The output of the remote electronics module 150 is input to the signal processing unit 200 for signal processing.

The camera head electro-optics module 106 provides for a variety of unique features. The camera head electro-optics module 106 comprises a modular camera sensor section which can accommodate a variety of infra-red focal point arrays, visual charge coupled device sensors, spectral filters, and optional Sterling cycle cryocoolers or thermoelectric temperature stabilizers. The camera head electro-optics module 106 also comprises a multi-field of view telescopic lens with a built-in miniaturized internal thermoelectric heater/cooler blackbody calibrator that can be slid in or out of the main optics path. The function of the calibrator is to provide a uniform known temperature object for the infra-red focal plane array gain and offset non-uniformity corrections as well as absolute radiometric calibration. In addition, the camera head electro-optics module 106 comprises a universal camera sensor interface and drive circuitry which is under microprocessor and/or field programmable gate array control, and which allows any infra-red focal plane array 102 or charge-coupled device 104 of different architectural designs to be interfaced rapidly with only minor changes in the state machine codes. This specific circuitry also allows the infra-red focal plane array 102 to be operated at variable frame rates and with different integration times, and allows sub-regions of the array to be read out in any sequence. All of these functions are accomplished by the control processor module, the timing generator module, the infra-red focal plane array driver/bias module, and the digitizer module which comprise the camera head electro-optics module 106 and are explained in detail in subsequent sections.

Figure 3:
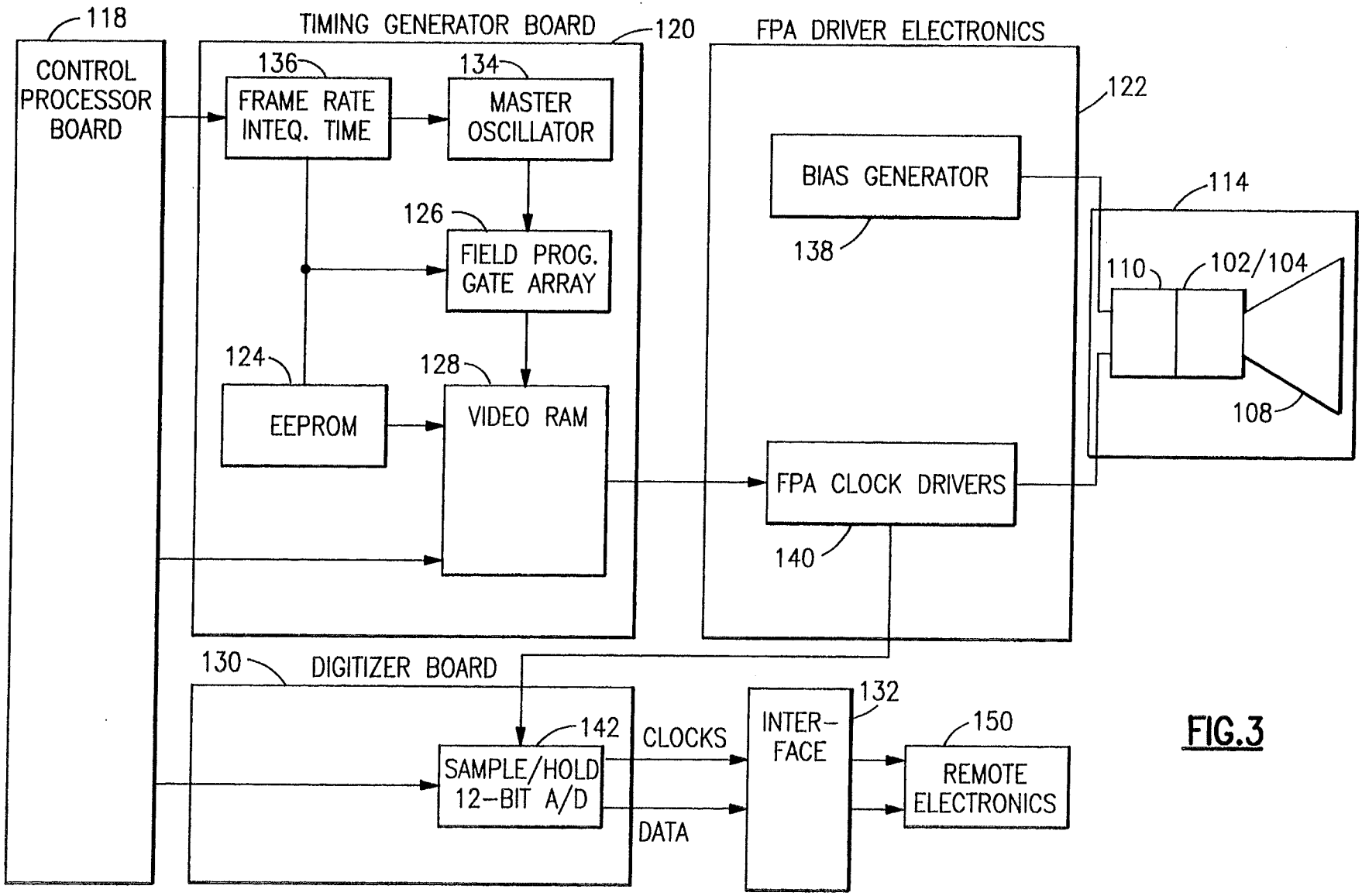
FIG. 3 is a block diagram representation of the camera head electro-optics module of the infra-red sensor system of the present invention.

Referring now to FIG. 3 there is shown a block diagram of the camera head electro-optics module 106. The camera sensor section 114 is an electro-optical module that is designed to allow different light receptor integrated circuits to be connected and integrated into the system. The light receptor, or array detector 102/104, can be an infra-red focal plane array 102 operating at room temperature, or thermally stabilized at ambient temperature by a thermoelectric cooler, or cooled to cryogenic temperatures by a miniaturized Stirling cycle cryocooler 110, or a visual band charge-coupled device imager 104. Mechanical interface adapters and associated structures are provided to self-align the array detector 102/104 along the optics axis and position the array detector 102/104 at the focal plane of the optics 108.

The optics 108 are either a visual band standard camera lens, or an infra-red telescopic lens or mirror with multiple field of views. At the exit pupil of the infra-red lens there is positioned a thermoelectric heater/cooler with a high emissivity coating. This heated or cooled high emissivity surface provides a uniform, diffused viewing surface of known radiative properties for the infra-red focal plane array 102. The signals measured by the infra-red focal plane array 102 of this surface at different temperatures provide the reference frames for camera response flat fielding and for radiometric calibration. Subsequent to the acquisition of the calibration reference, the flat fielding and the radiometric calibration data are stored in memory and applied to the raw data of the infra-red focal plane array 102 in real-time by the remote electronic module 150 described in detail subsequently.

The control processor board 118 contains a microcomputer with RAM, ROM, a serial interface and a parallel interface that allows complete control of the timing generator module 120 and infra-red focal plane array driver/bias module 122 so that different infra-red focal plane arrays of various dimensions and architectural design can be accommodated. The control processor board 118 handles signals from the remote electronics module 150, the local host computer 202 and from the infra-red sensor 102/104 interface.

The timing generator module 120 accepts control signals from the local control processor module 118 through the remote electronics module 150 or the local host processor 202. Both the local control processor 118 and the remote electronics module 150 contain the control logic that specifies the integration time and frame rates for the full frame readout, as detailed in the functional mode one description discussed above. The frame rates are adjustable in continuous steps from fifteen Hz to three hundred Hz. The integration time is adjustable in fractions from zero percent to one hundred percent of the frame period. The timing generator module 120 is a RAM based state machine for the generation of infra-red focal plane array timing signals and the timing signals for the digitizer module 130. The control processor module 118 has the capability to select from a ROM or EEPROM 124 the pre-programmed state machine codes for generating the clocking instructions and transferring them into the field programmable gate arrays 126, which in turn generates the multiple clocking patterns and stores them optionally into video RAM buffers 128. The output of the field programmable gate arrays 126 or video RAM buffers 128 are transmitted to the infra-red focal point array driver/bias module 122 which conditions the clocking pattern to the appropriate voltage levels and outputs them to drive the infra-red focal plane array 102/104. A master oscillator 134 provides the necessary clocking signals for the field programmable gate array 126. The frame rates and integration times from the remote electronics module 150 are input to a buffer 136 before being input to the field programmable gate array 126 or the EEPROM 124.

In the sub-frame readout mode, functional mode three, the timing signals are received from the local host processor 202 which are then downloaded into the video RAM buffers 128 of the timing generator 120 module and subsequently to the infra-red focal plane array driver/bias module 122. The sub-regions are addressed by selectively manipulating the x- and y-shift registers of the infra-red focal plane array 102/104. The calculation of the exact manipulation steps is performed by the local host processor 202.

The infra-red focal plane array driver/bias module 122 buffers the timing signals from the timing generator module 120 to the infra-red focal plane array 102/104 and provides for any amplitude control and level shifting. It is also used for the generation of infra-red focal plane array DC biases and bias level control. A twelve-bit digital-to-analog converter, under control processor control and which is part of the bias generator 138, is used to set the multiple bias lines needed to operate different types of focal plane arrays 102/104. Infra-red focal plane array drivers 140 condition the clocking pattern from the video RAM 128 to the appropriate voltage levels and outputs them to drive the infra-red focal plane array 102/104.

The digitizer module 130 converts the infra-red focal plane array video output into twelve-bit data and differentially shifts the data out to the remote electronics module 150. Clocking signals are received directly from the timing generator module 120 board. The vertical and horizontal synchronization signals together with the video blanking pulses are sent to the interface board 132. The digitizer 130 comprises offset and gain amplifiers and sample and hold circuitry with a twelve-bit analog to digital converter 142, controlled by the control processor module 118. Additional electronics are provided for black level clamping. The programmable digitizer module 130 can provide sample, hold and digitizing functions at dynamically adjustable clock rates so that different sub-regions for the infra-red focal plane array 102/104 can be sampled at different rates.

The interface module 132 provides differential line drivers for transmitting the parallel digitized infra-red focal plane array video to the remote electronics module 150 over twisted pair lines. It is also provided with bidirectional RS-422 buffering for the control processor's serial interface to the remote electronics module 150. The control processor 118 will have the ability to turn off the digitizer video to the interface module 132 and substitute a single parallel programmable word for output. This capability is used as a diagnostics tool. Additional timing signals from the timing generator module 120 will be buffered by the interface module 132 and sent with the parallel digitizer data for synchronization with the remote electronics module 150 electronics.

Figure 4:
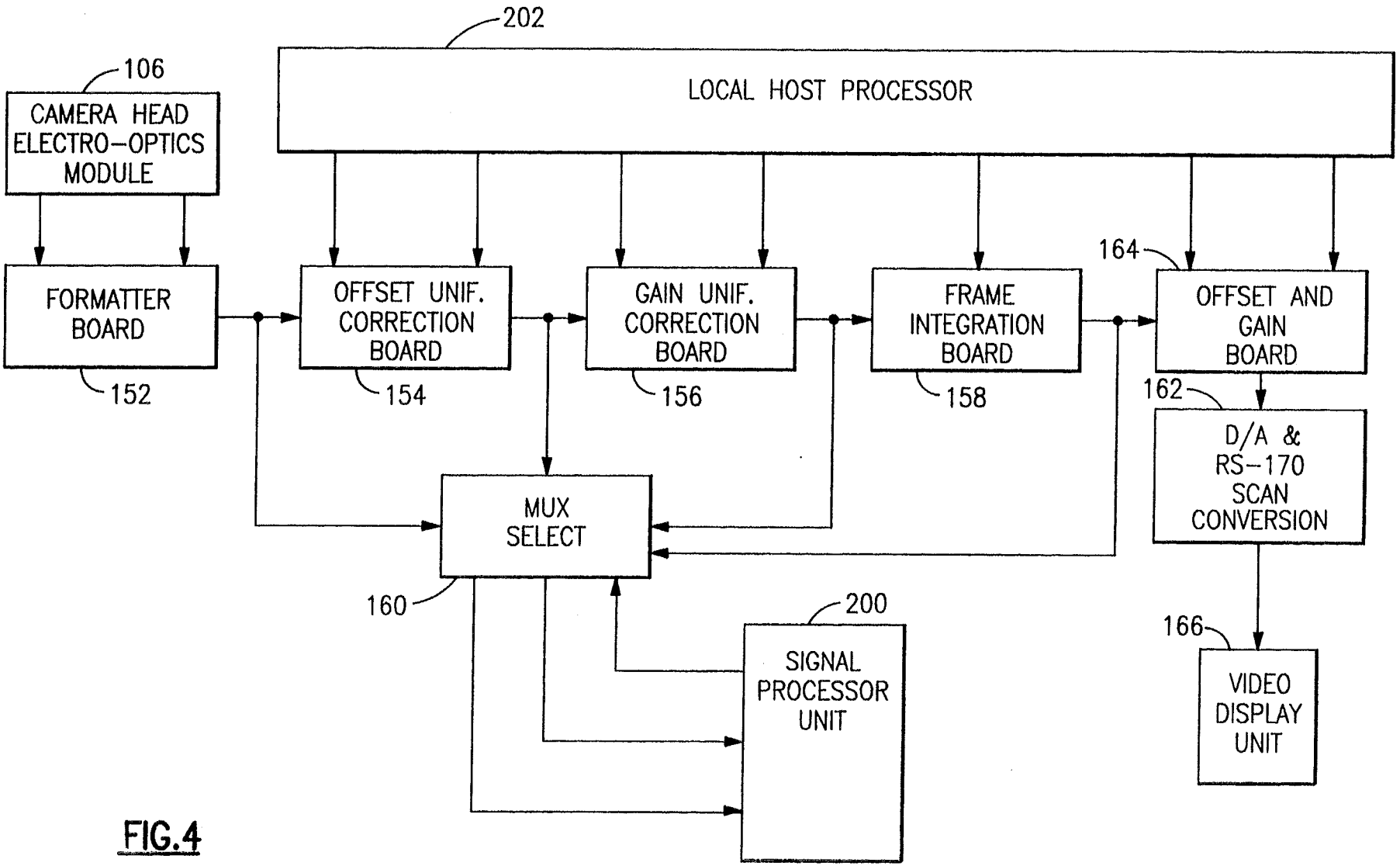
FIG. 4 is a block diagram representation of the remote electronics module of the infra-red sensor system of the present invention.

Referring to FIG. 4, there is shown a block diagram of the remote electronics module 150. The remote electronics module comprises four components which perform the various functions outlined above. The formatter and non-uniformity module 152 receives the digital data and timing signals from the camera head electro-optics module 106, re-sequences the data, generates a pixel address and then stores them in a frame buffer for subsequent processing. The pixel address is used to access the offset and gain correction look-up tables from their RAM memory. At regular intervals, a calibrator source, which is a thermoelectric cooler/heater coated with a high emissivity coating, located in the optics of the camera is switched by a motor to fill the field of view of the infra-red focal plane array 102/104. The output signals of the infra-red focal plane array 102/104 with the calibrator set at two different temperatures are recorded. When the calibration signal is received, either from the local host processor 202, or from a system operator, the raw digital data is stored. Thereafter, the calibrator is removed and subsequent input data is corrected for the offset and gain variations by the offset uniformity correction module 154 and the gain uniformity correction module 156, according to the equation given by $$x1=a+b*(x0-ref1)/(ref2-ref1), \quad (1)$$

where x1 is the corrected image, x0 is the raw image, ref1 and ref2 are the reference images with the infra-red focal plane array 102/104 viewing the calibrator at two different temperatures, and a and b are calibration scaling constants. The above corrections are implemented via a hardware adder and a hardware multiplier. All corrections can be set to zero under computer or manual control. Bad pixels can also be corrected in the process by flagging the address of the bad pixels and substituting with the nearest neighbors signal amplitude, gain coefficients and offset coefficients.

The corrected output data then enter a frame buffer 158 for integration. The number of frames to be integrated is selected by the local host processor 202 or a front panel switch in discrete steps of one, two, four, eight and sixteen frames. These integration steps can effectively increase the dynamic range of the sensor electronics. Two bank buffers are used for frame integration so that one buffer can be used for output while the other buffer is being integrated. The interface processor can freeze frame the integration buffer and read/write its contents for computation of look-up table correction factors. A digital multiplexer 160 is used to select the digital output video which can be either the raw video, gain and offset corrected video, or the integrated video. The output of the multiplexor 160 is directed to the signal processor unit 200. Timing data is output along with the digital data in parallel RS-422 format.

The scan converter module 162 takes the digital RS-422 video image from the integrator's 158 output and converts it into an analog video image in standard RS-170 format and outputs it to a video display unit 166, A gain and offset value is set by an offset and gain module 164 which is selected, either by the local host processor 202 or under manual control to selectively window the digital data into eight-bit dynamic range. A digital-to-analog converter then converts the digital video into analog video, and inserts the appropriate analog video synchronization signals to be in compliance with the RS-170 standard.

The interface processor module 132, shown in FIG. 3, contains a microcomputer which controls the remote electronics module 150 and provides for the remote control interface and interface to the control processor 118 in the camera head electronics module 106 also shown in FIG. 3. The interface processor module 132 also interfaces to the manual controls, computes the offset and gain correction factors from freeze frame data, integration time data, and state machine code to the camera head electronics, and performs diagnostics. Flash ROM memory is also available on the interface processor module 132 for storing look-up correction data over power down periods so that it can be used to initialize the RAM look-up tables at power-up.

Infra-Red Sensor System Operation

The data from the infra-red and visual band imagers are processed to yield certain information, including the density, the position, and the velocity of individual vehicles within the field of view. Application specific algorithms are utilized to extract and process the captured images from the infra-red and visual band sensors. The final result of the processing is a data stream of approximately one hundred bytes per seconds.

Nominally, the present system is designed to provide data to the local host controller once a second. However, additional averaging over any selectable time interval may be made so that the data rate may be adjusted to be compatible with any other communication link requirements. During routine operation, only a limited set of data is transmitted to the control room. Accordingly, if additional information needs to be transmitted, an additional algorithm can be provided to compress images for transmission to the central control room.

Figure 5:
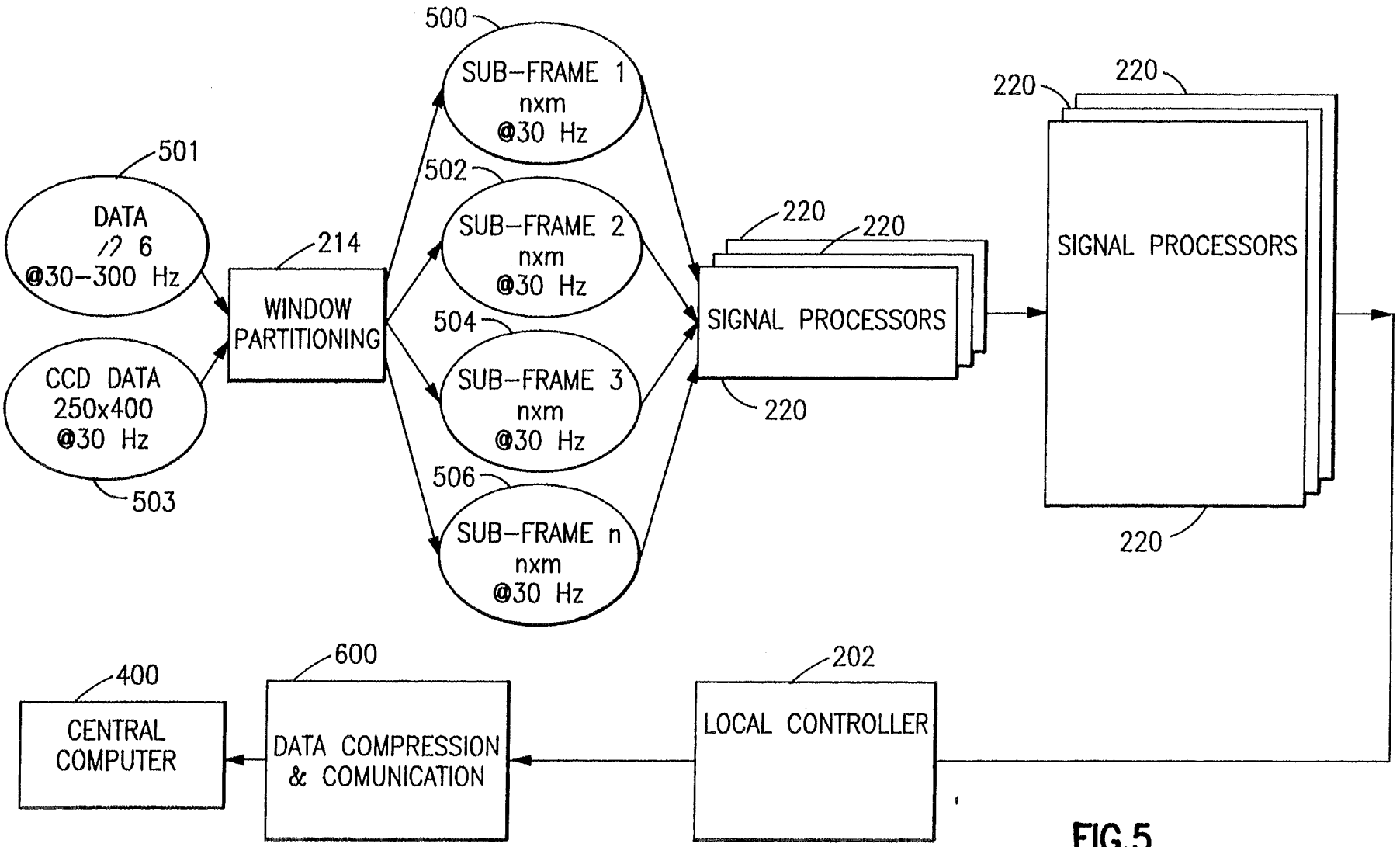
FIG. 5 is a diagrammatic representation of the data processing stream of the infra-red sensor system of the present invention.

Referring to FIG. 5, there is shown a schematic overview of the data processing stream of the present invention. The raw data 501 and 503 from the infra-red and visual band imagers 102 and 104, illustrated in FIGS. 1 and 2, are partitioned into multiple subwindows 500, 502, 504, 506 by the window processor 214 circuitry. Each subwindow 500, 502, 504 and 506 or sub-region is then processed independently by a particular signal processor 220. Two sets of signal processors 220 are shown to illustrate the separate functions the signal processors 220 perform. The sub-regions of data 500, 502, 504, and 506 are processed in both the spatial and temporal domain to identify vehicles and reject people, buildings, or other background clutter. Accordingly, the first function performed is clutter rejection by means of a spatial filter. Then the signal processors perform multi-target tracking, temporal filtering, detection, track initiation, association and termination, and track reporting. The output of the signal processors 220 is sent to the local host controller 202 for time-tagging, position, speed, flow rate and density recording. Finally, the data from the local host controller 202 is compressed and transmitted by hardware and software means 600 to the central computer 400.

The processing of data received from a particular array detector provides for the determination of the position, number, velocity and acceleration of vehicles which are in the field of view of the particular array detector. The tracker algorithms for determining this information are based upon bright point detection and the accumulation of the locations of these bright points over several frames. Each frame represents an increment of time. The size of the increment depends upon the number of frames per second chosen to evaluate a specific phenomenon. Bright points are "hot spots" in the infra-red images captured by the array detector. The exhaust of a vehicle is one such hot spot which shows in the image as a bright point and the radiator and tires are other examples of hot spots. Accordingly, the number of bright points corresponds to the number of vehicles in the image. Once these right points are accumulated, a smooth curve is fit between these points to determine the location of the vehicle as a function of time. This fit curve is then used to determine the velocity and acceleration of the vehicles. Any number of curve fitting techniques can be utilized, including least squares and regression.

Figure 6:
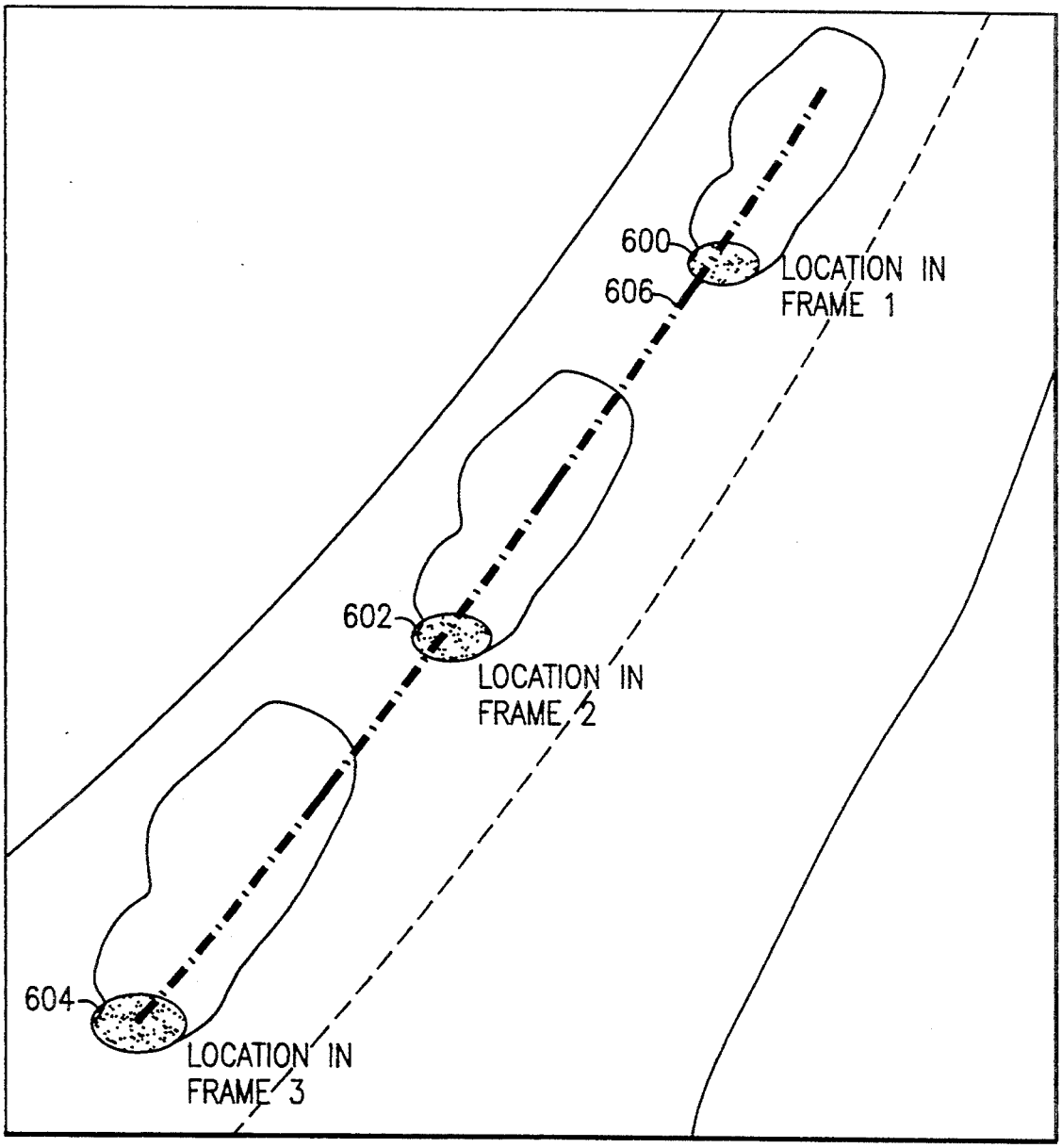
FIG. 6 is a diagrammatic representation of a sample curve fitting technique utilized by the infra-red sensor system of the present invention.

The algorithms utilized to determine the position, velocity, linear acceleration, and lateral acceleration of the vehicles are all based on techniques well known in the estimation art. The most simplistic approach is an algorithm that would centroid the hot spots in the image, the radiators of the vehicles if they are traveling towards the infra-red sensor or the exhaust of the vehicles if they are travelling away from the infra-red sensor, in each image frame. The location of these hot spots, from frame to frame, will change as a consequence of the motion of the vehicle. By saving the coordinates of these locations over a multiplicity of frames, a curve can be developed in a least squares sense that is the trajectory in the focal plane coordinates of the vehicle's motion. This least squares curve can then be used to determine the velocity, linear and lateral acceleration in the focal plane coordinates. Then through the knowledge of the infra-red sensor location in the vicinity of the traffic motion, the transformation from the focal plane coordinates to the physical location, velocity and linear and lateral acceleration of each vehicle is easily determined. Referring to FIG. 6, there is shown a simplified representation of the curve fitting technique utilized by the infra-red sensor system. The x and y coordinates of the hot spots 600, 602, and 604 over a period of three frames in the focal plane each have a least squares fit as a function of time. Once the bright points 600, 602, and 604 are detected, a curve 606 is fit between these points 600, 602 and 604 utilizing a least squares fit. It should be noted that other curve fitting techniques can be utilized. Accordingly, x(t) and y(t) are the focal plane coordinate motions of the vehicle. These are translated into vehicle motion as a function of time from the knowledge of the geometry of the infra-red sensor which captured the image. Acceleration and velocity in both the linear and lateral directions are determined from x(t) and y(t) and their derivatives. The information on the lateral acceleration is then used to detect excessive weaving in the vehicle of interest for potential hand off to local law enforcement officials for possible DWI action.

The infra-red sensor system is also configurable to determine the emission content of the vehicles passing within the field of view of the array detector. A spectral filter is mounted on the surface of the focal plane of the array detector. The spectral filter serves to divide the wavelength of infra-red radiation in the two to four micron range into smaller segments. Each compound in the exhaust streams of vehicles has a unique signature in these wavelengths. The measurement algorithm for emission content determination quantifies the unique wavelengths of gases such as Nitrogen, Carbon Monoxide, Carbon Dioxide, unburned hydrocarbons and other particulants such as soot. The measurement algorithm is a simple pattern matching routine. The measurement algorithm is used in conjunction with the tracking algorithms to determine the pollution levels of all vehicles that pass within the field of view of the array detector. Obviously, the tracking algorithms will have no trouble with exhaust because the exhaust will appear as an intense bright point. The infra-red system can also be used to determine absolute levels of pollution so that ozone non-attainment areas can be monitored.

Figure 7:
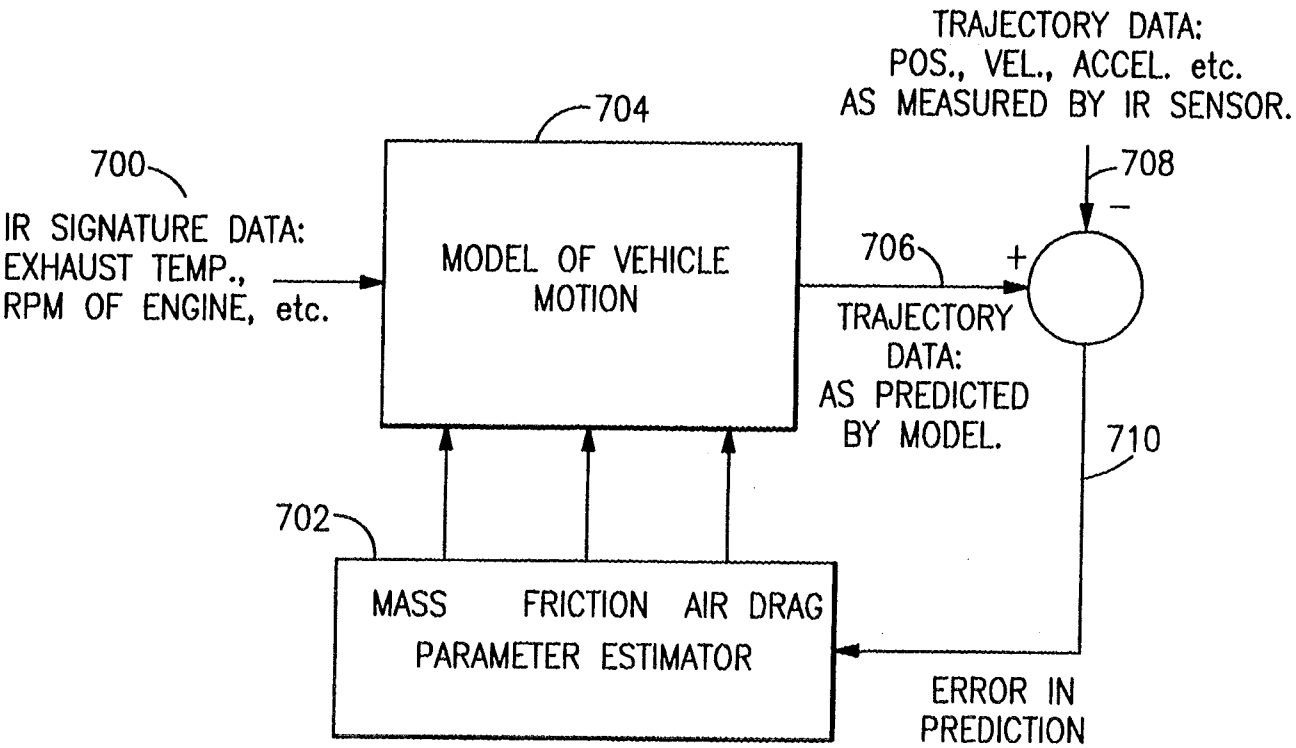
FIG. 7 is a diagrammatic model illustrating the operation of an algorithm for calculating the mass of a vehicle which is utilized by the infra-red sensor system of the present invention to determine engine RPM.

The infra-red sensor system is also operable to determine the mass of the individual vehicles passing within a particular detectors field of view. The determination of the vehicle mass from the data collected by the the infra-red sensor can be achieved in several ways. One method for determining mass is to create a physical model of the dynamics of a particular vehicle. A typical model for a vehicle riding along a section of roadway that is at an angle Θ with respect to the local horizontal is that the mass, m, times the acceleration, $\ddot{x}$, is given by $$mx = \textit{force applied} - \textit{air drag} - \textit{friction} - mg \sin(\Theta), \quad (2)$$

where g is the force of gravity. In this particular model, the air drag is proportional to the velocity of the vehicle squared, and the friction force is proportional to the mass of the vehicle on the wheels. The force applied is a non-linear function of the engine rpm and the amount of fuel/air being consumed by the engine. The infra-red sensor allows the engine rpm to be determined from the puffing of the exhaust that is created by the opening and closing of the exhaust valves on the engine. The exhaust of a vehicle varies in intensity as a function of time because of the manner in which exhaust is created. Each piston stroke in a four cycle engine corresponds to a unique event. The events in sequence are the intake stroke, the compression stroke, the combustion stroke and then finally the exhaust stroke. On the exhaust stroke the exhaust valve or valves for that cylinder open and the exhaust gases from the combustion of gasoline and air are expelled from the cylinder. Therefore, for each cylinder two complete revolutions are required before gases are exhausted. The pattern is cyclical and therefore easily trackable as long as it is being observed at a fast enough rate. The throttle setting which determines the fuel air mixture, can be determined from the total energy in the exhaust, which is proportional to the exhaust temperature. This can be obtained by measuring the infra-red signature from the entire exhaust plume as the vehicle moves away. In addition, the trajectory metric obtained in the tracker algorithm (i.e. position, velocity and acceleration) are also used. The engine rpm with the vehicle velocity determines the gear that is being used. The operation of the vehicle on a level section of roadway would allow the friction force and the engine model to be calibrated since when the vehicle is not accelerating, the air drag and friction are just balanced by the applied force. Then as the vehicle transitions into an up hill grade, the acceleration due to gravity must be overcome, and the work that the engine must do to overcome this grade would allow the further refimement of the model parameters. The mass would then be derived from fitting the model of the vehicle to all of the observed and derived data (the velocity, acceleration, total exhaust energy, rpm, etc.). The method for doing the model fitting is well understood as part of the general subject of "system identification" wherein data collected is used to fit, in a statistical sense, the parameter models. Among the many procedures for doing this are least squares, maximum likelihood, and spectral methods. FIG. 7 illustrates a simple model which the algorithm utilizes to calculate the mass of a particular vehicles. The infra-red signature data 700, along with mass, friction and air drag information from a parameter estimator 702 is utilized by a modelling portion 704 of the algorithm to generate a model of the vehicle motion. The trajectory motion 706, as predicted by the model 704 is compared to the actual trajectory data 708 as determined by the infra-red sensors, thereby generating an error signal 710. The error signal 710 is then fed back into the parameter estimator portion 702 of the algorithm. The parameter estimator 702 is a least squares or maximum likelihood estimator which utilizes minimization of error to find the best parameter fits. The parameter estimator 702 utilizes the error signal 710 to generate new estimated values for mass, friction and air drag. Essentially, the algorithm is a classic feedback control system.

Figure 8:
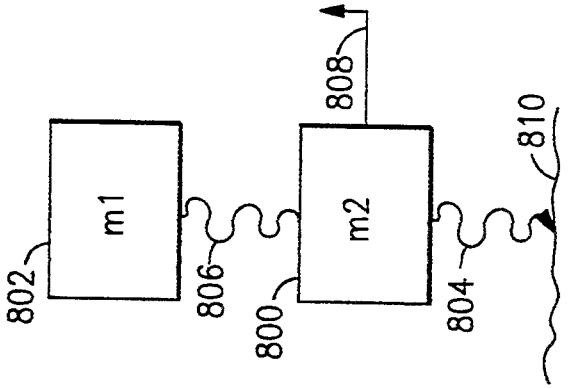
FIG. 8 is a diagrammatic representation of a vehicle modelled as a mass/spring system.
Figure 9:
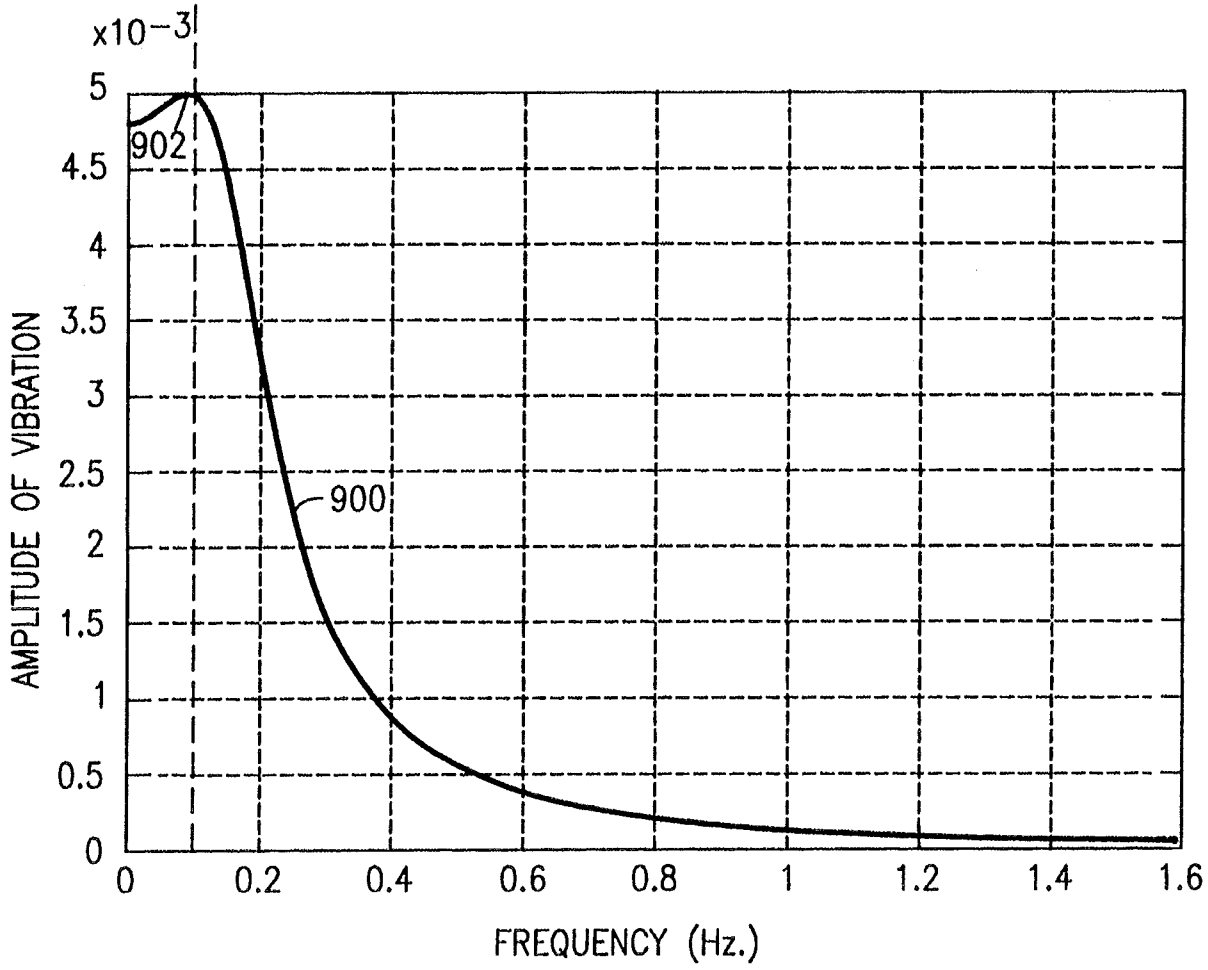
FIG. 9 is a sample plot of the motion of a vehicle's tire as it responds to road irregularities.

A second possible way of using the infra-red sensor to measure vehicle mass would be to observe the motion of the vehicle and the tires as the vehicle moves along the roadway. The roadway irregularities can be thought of as a random process that excites the springs and masses that the vehicle represents into motion. These "springs" are both the physical springs that suspend the vehicle on its axles, and the springs that result from the air in the various tires on the vehicle. The net result of the motion of the tires over the rough roadway is that the tire "bounces" in a random way. The combined motion of the various mass and springs will induce a response that can, through the same system identification approach that was described above, in the sense that the system can be modeled in such a way that the underlying parameters of the model may be deduced. In this case, the model would have in it the masses of the component parts and the spring constants of the physical springs and the tires. These can be assumed to be known for a particular brand of vehicle, and the unknown mass can be computed from the model. A typical model that represents vehicle and tire masses and springs is shown in FIG. 8. The model is a simple two mass 800 and 802, two spring system 804 and 806. The axle and tire mass 800 is designated $m_1$, and the vehicle mass 802 is represented as $m_2$. The tire spring 804 is represented by the spring constant $k_1$, and the vehicle suspension spring 806 is represented by the constant $k_2$. Line 808 represents the reference point for observed motion as the vehicle tires bounce over the roadway surface 810. The resulting motion for the tire as it responds to the road irregularities is shown in FIG. 9. FIG. 9 is a simple plot 900 of the amplitude of vibration versus the frequency of vibration. From the resonant peak 902 in the frequency response curve 900, the values of the masses of the various components in the vehicle can be determined. The equation for the resonant frequency (in rad/sec) is given by $$f=\sqrt{\frac{\left(\frac{k_1}{m_1}+\frac{k_2}{m_2}\right)-\sqrt{\left(\frac{k_1}{m_1}+\frac{k_2}{m_2}\right)^2-4\left(\frac{k_1}{m_1}\ \frac{k_2}{m_2}-\frac{k_1^2}{m_1\,m_2}\right)}}{2}}\ . \quad (3)$$

This method is a "spectral method". There are many other ways of developing the model parameters.

Although shown and described is what is believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

What is claimed is:

1. A sensor unit comprising:

(a) detector means including an infra-red focal plane array for capturing images of interest;

(b) an electro-optics module having means for focusing said images of interest onto said detector means, means for controlling said detector means, an array of multiple distributed processors, and means for generating a respective one set of video signals from each of at least selected images captured by said detector means and for transmitting each set of signals to at least a plurality of the distributed processors; and (c) a remote electronics module for conditioning and transforming said video signals from said electro-optics module into a form suitable for digital signal processing, said remote electronics module is connected to said electro-optics module via an interface module contained within said electro-optics module; and wherein the sensor unit further includes i) an array of multiple distributed processors, and ii) signal circuitry for generating a respective set of signals representing each of at least selected ones of said images, and for transmitting each set of signals to at least a plurality of the distributed processors.

2. The sensor unit according to claim 1, wherein said detector means is a charge-coupled device imager.

3. The sensor unit according to claim 2, wherein said electro-optics module and said remote electronics module are separated a predetermined distance to avoid interference.

4. The sensor unit according to claim 3, wherein said means for focusing images of scenes of interest is a multi-field of view telescopic lens with a built-in miniaturized internal thermoelectric heater/cooler blackbody calibrator that can be slid in or out of the main optics path.

5. The sensor unit according to claim 3, wherein said means for focusing images of scenes of interest is a standard visual band camera lens.

6. An infra-red sensor system for tracking ground based vehicles to determine traffic information, said system comprising:

(a) a sensor unit having at least one array detector for continuously capturing images of a particular traffic corridor, a first portion of said sensor unit being mounted on an overhead support structure such that said at least one array detector has an unobstructed field of view of said traffic corridor;

(b) a signal processor unit connected to said sensor unit for extracting data contained within said images captured by said at least one array detector and calculating traffic information therefrom, including the location, number, weight, axle loading, velocity, acceleration, lateral acceleration, and emission content of said ground based vehicles passing within the field of view of said at least one array detector; and (c) a local controller unit connected to said signal processor unit for providing and controlling a communications link between said infra-red sensor system and a central control system, said central control system comprising a central computer operable to process information from a multiplicity of infra-red sensor systems; wherein at least one said array detector includes an infra-red focal plane array; and the sensor unit further includes i) an array of multiple distributed processors, and ii) signal circuitry for generating a respective set of signals representing each of at least selected ones of said images, and for transmitting each set of signals to at least a plurality of the distributed processors.

7. The infra-red sensor system for tracking ground based vehicles to determine traffic information according to claim 6, wherein said sensor unit comprises two array detectors, a first of said two array detectors being a passive infra-red focal plane array and a second of said two array detectors being a visual band charge-coupled device imager.

8. The infra-red sensor system for tracking ground based vehicles to determine traffic information according to claim 7, wherein said sensor unit further comprises:

(a) an electro-optics module having means for focusing images of said traffic corridor onto said two array detectors, means for controlling said two array detectors and means for generating video signals from images captured by said two array detectors; and (b) a remote electronics module for conditioning and transforming said video signals from said electro-optics module into a form suitable for input to said signal processor unit, said remote electronics module is connected to said electro-optics module via an interface module contained within said electro-optics module.

9. The infra-red sensor system for tracking ground based vehicles to determine traffic information according to claim 8, wherein said electro-optics module is contained within said first portion of said sensor unit and said remote electronics module being mounted remotely from said electro-optics module to eliminate interference therewith.

10. The infra-red sensor system for tracking ground based vehicles to determine traffic information according to claim 9, wherein said signal processor unit comprises:

(a) signal conditioning circuitry for electrically processing said video signals from said remote electronics module and transforming said video signals into a format suitable for digital signal processing;

(b) an array of multiple distributed processors and associated memory, said associated memory comprising a plurality of algorithms which said array of multiple distributed processors utilize to calculate the location, number, weight, axle loading, velocity, acceleration, lateral acceleration, and emission content of said ground based vehicles passing within the field of view of said two array detectors, said array of multiple distributed processors receive input from signal conditioning circuitry;

(c) a local host computer for providing a user interface with said array of multiple distributed processors, and for providing control signals for operating said infra-red sensor system, said local host computer providing a link to said local controller unit, and said local host computer comprises means for controlling local area traffic signals; and (d) a bi-directional data bus interconnecting and providing a data link between said signal conditioning circuitry, said array of multiple distributed processors and associated memory, and said local host computer.

11. The infra-red sensor system for tracking ground based vehicles to determine traffic information according to claim 10, wherein said signal conditioning circuitry comprises window processing circuitry for partitioning said video signals into multiple sub-regions so that each sub-region can be directed to one of several signal processors which comprise said array of multiple distributed processors.

12. The infra-red sensor system for tracking ground based vehicles to determine traffic information according to claim 11, wherein said signal processor unit is housed in a single chassis, said chassis comprising a power supply for said signal processor unit.

13. The infra-red sensor system for tracking ground based vehicles to determine traffic information according to claim 12, wherein said array of multiple distributed processors and associated memory and said window processing circuitry are expandable.

14. The infra-red sensor system for tracking ground based vehicles to determine traffic information according to claim 13, wherein said local controller unit comprises a microprocessor based controller having a data interface and modem for providing a two-way communication link between said infra-red sensor system and said central computer.

15. The infra-red sensor system for tracking ground based vehicles to determine traffic information according to claim 14, wherein said data interface is a serial RS-232 compatible data line.

16. A passive, all weather, day/night infra-red sensor system for tracking ground based vehicles to determine traffic information, said system comprising:

(a) a sensor unit having two array detectors for continuously capturing images of a particular traffic corridor, a first portion of said sensor unit being mounted on an overhead support structure such that said two array detectors have an unobstructed field of view of said traffic corridor, a first of said two array detectors being a passive infra-red focal plane array and a second of said two array detectors being a visual band charge-coupled device imager, wherein the sensor unit further includes an array of multiple distributed processors, and signal circuitry for generating a respective set of signals representing each of at least selected ones of said images and for transmitting each set of signals to at least a plurality of the distributed processors;

(b) a signal processor unit connected to said sensor unit for extracting data contained within said images captured by said two array detectors and calculating traffic information therefrom, including the location, number, weight, axle loading, velocity, acceleration, lateral acceleration, and emission content of said ground based vehicles passing within the field of view of said two array detectors; and (c) a local controller unit connected to said signal processor unit for providing and controlling a communications link between said infra-red sensor system and a central control system, said central control system comprising a multiplicity of infra-red sensor systems.

17. The passive, all weather, day/night infra-red sensor system for tracking ground based vehicles to determine traffic information according to claim 16, wherein sensor unit comprises a seismic sensor.

18. The passive, all weather, day/night infra-red sensor system for tracking ground based vehicles to determine traffic information according to claim 16, wherein said sensor unit comprises an acoustic sensor.

19. The passive, all weather, day/night infra-red sensor system for tracking ground based vehicles to determine traffic information according to claim 16, wherein said passive infra-red focal plane array is a staring mosaic sensor having 480×640 pixel elements being operable to respond to a broad range of frequencies.

20. The passive, all weather, day/night infra-red sensor system for tracking ground based vehicles to determine traffic information according to claim 19, wherein said sensor unit further comprises:

(a) an electro-optics module having means for focusing images of said traffic corridor onto said two array detectors, means for controlling said two array detectors, and means for generating video signals from images captured by said two array detectors; and (b) a remote electronics module for conditioning and transforming said video signals from said electro-optics module into a form suitable for input to said signal processor unit, said remote electronics module is connected to said electro-optics module via an interface module contained within said electro-optics module.

21. The passive, all weather, day/night infra-red sensor system for tracking ground based vehicles to determine traffic information according to claim 20, wherein said electro-optics module is contained within said first portion of said sensor unit and said remote electronics module being mounted remotely from said electro-optics module to eliminate interference therewith.

22. The passive, all weather, day/night infra-red sensor system for tracking ground based vehicles to determine traffic information according to claim 21, wherein said signal processor unit comprises:

(a) signal conditioning circuitry for electrically processing said video signals from said remote electronics module and transforming said video signals into a format suitable for digital signal processing:

(b) an array of multiple distributed processors and associated memory, said associated memory comprising a plurality of algorithms which said array of multiple distributed processor utilize to calculate the location, number, weight, axle loading, velocity, acceleration, lateral acceleration, and emission content of said ground based vehicles passing within the field of view of said two array detectors, said array of multiple distributed processors receive input from said signal conditioning circuitry;

(c) a local host computer for providing a user interface with said array of multiple distributed processors, and for providing control signals for operating said infra-red sensor system, said local host computer providing a link to said local controller; and (d) a bi-directional data bus interconnecting and providing a data link between said signal conditioning circuitry, said array of multiple distributed processors and associated memory, and said local host computer.

23. The passive, all weather, day/night infra-red sensor system for tracking ground based vehicles to determine traffic information according to claim 22, wherein said signal conditioning circuitry comprises window processing circuitry for partitioning said video signals into multiple sub-regions so that each sub-region can be directed to one of several signal processors which comprise said array of multiple distributed processors.

24. The passive, all weather, day/night infra-red sensor system for tracking ground based vehicles to determine traffic information according to claim 23, wherein said signal processor unit comprises means for processing said multiple sub-regions in the temporal domain and the spatial domain.

25. The passive, all weather, day/night infra-red sensor system for tracking ground based vehicles to determine traffic information according to claim 24, wherein said sensor unit comprises spectral filters such that said signal processor unit is operable to process data in the spectral domain.

26. The passive, all weather, day/night infra-red sensor system for tracking ground based vehicles to determine traffic information according to claim 25, wherein said signal processor unit is housed in a single chassis, said chassis comprising a power supply for said signal processor unit.

27. The passive, all weather, day/night infra-red sensor system for tracking ground based vehicles to determine traffic information according to claim 26, wherein said array of multiple distributed processor and associated memory and said window processing circuitry is expandable.

28. The passive, all weather, day/night infra-red sensor system for tracking ground based vehicles to determine traffic information according to claim 27, wherein said local controller unit comprises a microprocessor based controller having a data interface and modem for providing a two-way communication link between said infra-red sensor system and said central computer.

29. The passive, all weather, day/night infra-red sensor system for tracking ground based vehicles to determine traffic information according to claim 28, wherein said data interface is a serial RS-232 compatible data line.

30. A passive infra-red sensor unit comprising:

(a) an electro-optics module having at least one passive infra-red focal plane array detector for continuously capturing images of scenes of interest, means for focusing images of said scenes of interest onto said at least one array detector, means for controlling said at least one array detector, an array of multiple distributed processors, and means for generating a respective one set of video signals from each of at least selected images captured by said at least one array detector and for transmitting each set of signals to at least a plurality of the distributed processors; and (b) a remote electronics module for conditioning and transforming said video signals from said electro-optics module into a form suitable for digital signal processing, said remote electronics module is connected to said electro-optics module via an interface module contained within said electro-optics module.

31. The passive infra-red sensor unit according to claim 30, wherein said electro-optics module and said remote electronics module are separated a predetermined distance to avoid interference.

32. The passive infra-red sensor unit according to claim 31, wherein said at least one passive infra-red focal array detector is a staring mosaic sensor having 480×640 pixel elements being operable to respond to a broad range of frequencies.

33. The passive infra-red sensor unit according to claim 32, wherein said means for focusing images of scenes of interest is a multi-field of view telescopic lens with a built-in miniaturized internal thermoelectric heater/cooler blackbody calibrator that can be slid in or out of the main optics path.

34. The passive infra-red sensor unit according to claim 32, wherein said means for focusing images of scenes of interest is a visual bond standard camera lens.

35. A sensor system comprising:

(a) a sensor unit having at least one detector means for continuously capturing images of interest;

(b) a signal processor unit linked to said sensor unit for extracting data contained within said images; and (c) a local controller unit linked to said signal processor unit for providing and controlling a communications link between said sensor system and a central controller system, said central control system comprising a central computer operable to process, utilize, and disseminate the data from said signal processor; wherein at least one said array detector includes an infra-red focal plane array; and the sensor unit further includes i) an array of multiple distributed processors, and ii) signal circuitry for generating a respective set of signals representing each of at least selected ones of said images, and for transmitting each set of signals to at least a plurality of the distributed processors.

36. The sensor system according to claim 35, wherein said at least one detector means is a charged-coupled device imager.

37. The sensor system according to claim 36, wherein said sensor unit further comprises:

(a) an electro-optics module having means for focusing said images of interest onto said charged-coupled device imager, means for controlling said charged-coupled device imager, and means for generating video signals from images captured by said charged-coupled device imager; and (b) a remote electronics module for conditioning and transforming said video signals from said electro-optics module into a form suitable for input to said signal processor unit, said remote electronics module is linked to said electro-optics module via an interface module.

38. The sensor system according to claim 37, wherein said electro-optics module is contained within a first portion of said sensor unit and said remote electronics module being mounted remotely from said electro-optics module to eliminate interference therewith.

39. The sensor system according to claim 38, wherein said signal processor unit comprises:

(a) signal conditioning circuitry for electrically processing said video signals from said remote electronics module and transforming said video signals into a format suitable for digital signal processing;

(b) an array of multiple distributed processors and associated memory, said array of multiple distributed processors receiving input from said signal conditioning circuitry, and said associated memory comprising a plurality of algorithms which are implemented by said array of multiple distributed processors;

(c) a local host computer for providing a user interface with said array of multiple distributed processors, and for providing control signals for operating said sensor system, said local host computer providing a link to said local controller unit; and (d) a bi-directional data bus interconnecting and providing a data link between said signal conditioning circuitry, said array of multiple distributed processors and associated memory, and said local host computer.

40. The sensor system according to claim 39, wherein said signal conditioning circuitry comprises window processing circuitry for partitioning said video signals into multiple sub-regions so that each sub-region can be directed to one of several signal processors which comprise said array of multiple distributed processors.

41. The sensor system according to claim 40, wherein said signal processor unit is housed in a single chassis, said chassis comprising a power supply for said signal processor unit.

42. The sensor system according to claim 41, wherein said array of multiple distributed processors and associated memory, and said window processing circuitry are expandable.

43. The sensor system according to claim 42, wherein said local controller unit comprises a microprocessor based controller having a data interface and modem for providing a two-way communication link between said sensor system and said central computer.

44. The sensor system according to claim 43, wherein said data interface is a serial RS-232 compatible data line.

* * * * *